United States Patent [19]

Arora

[11] 4,315,806

[45] Feb. 16, 1982

[54] INTERMITTENT AC ETCHING OF ALUMINUM FOIL

[75] Inventor: Mulk A. Arora, Williamston, Mass.

[73] Assignee: Sprague Electric Company, North Adams, Mass.

[21] Appl. No.: 188,637

[22] Filed: Sep. 19, 1980

[51] Int. Cl.[3] ..... C25F 3/04

[52] U.S. Cl. ..... 204/129.4; 204/129.43

[58] Field of Search ..... 204/129.6, 129.43, 129.4

[56] References Cited

U.S. PATENT DOCUMENTS 3,193,485 7/1965 Vincent ..... 204/129.43

4,214,961 7/1980 Anthony ..... 204/129.1

FOREIGN PATENT DOCUMENTS 879768 10/1961 United Kingdom ..... 204/129.6

*Primary Examiner*—T. M. Tufariello

*Attorney, Agent, or Firm*—Connolly and Hutz

[57] ABSTRACT

Aluminum electrolytic capacitor foil is etched by subjecting the foil to etching for a period of time, followed by a rest period during which no etching takes place, subjecting the foil to etching for another period, followed by another rest period, and repeating these steps until the foil is etched to the desired level. An alternating current is used.

6 Claims, 1 Drawing Figure

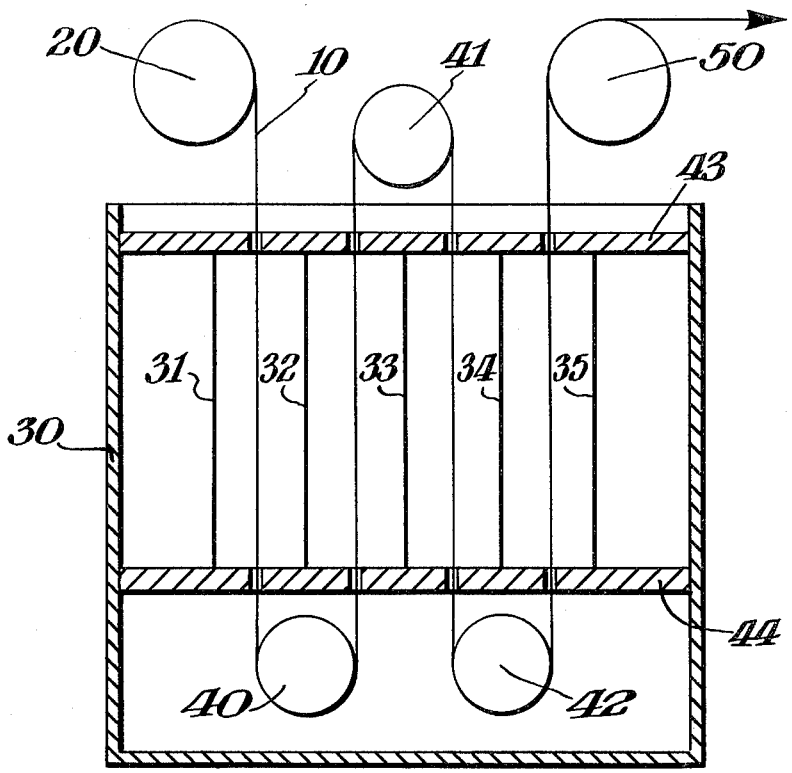
20
10
41
50
43
31
32
33
34
35
30
44
40
42

INTERMITTENT AC ETCHING OF ALUMINUM FOIL

BACKGROUND OF THE INVENTION

This invention relates to the etching of aluminum electrolytic capacitor foil using alternating current and several passes of equal duration alternating with periods of non-etching.

The prior art has shown the interrupted AC etching of aluminum capacitor foil, but such interruptions have been for the purpose of changing electrolytes or electrolyte connections, for an intermediate anodization, or for completion of the etching in a DC stage. AC etching has been carried out also in a series of tanks with the foil acting as one electrode.

It is desirable to have many etch sites per unit area of foil surface (etch density) without mechanically weakening the foil for subsequent processibility.

SUMMARY OF THE INVENTION

The present invention proposes a method of etching aluminum electrolytic capacitor foil to increase its surface area and hence capacitance. The foil is intermittently etched for several periods of equal duration using alternating current with intervening periods during which no etching takes place.

The electrodes are so arranged and insulated that the current can only pass through the foil and there is no stray or fringing current. Thus, the amount of etching can be closely controlled, and all current passed is utilized for etching.

BRIEF DESCRIPTION OF THE DRAWING

The sole FIGURE depicts the etching of aluminum capacitor foil by the process of the present invention.

DESCRIPTION OF THE PREFERRED EMBODIMENT

Aluminum foil 10 is passed over roll 20 into etching tank 30 between insulated electrodes 31 and 32, under roll 40 and between electrodes 32 and 33, over roll 41 and between electrodes 33 and 34, under roll 42 and between electrodes 34 and 35, and out of tank 30 and over roll 50. The electrodes are carried by insulated frames 43 and 44 that have openings for passage of foil 10. More electrodes and rolls may be used than shown. In fact, it is more efficient to use more electrodes, but enough have been shown to illustrate the invention.

Because the electrodes 31, 32, 33, 34 and 35 are mounted in insulated frames 43 and 44, the alternating current passed through them is forced to pass through the foil and not through the main body of etchant solution. In this way, the foil is electrochemically etched during the time the foil passes between a pair of electrodes and not electrochemically etched when outside the frame, e.g., between frame 44 and roll 40.

The laboratory device used to determine etch time $t_1$ and rest time $t_2$ was a static device with the alternating current being turned on and off to simulate periods when the foil was between electrodes and periods when the foil was out of the field of the electrodes.

Other designs may be used than the one shown here. The present invention relates to the discovery that capacitance is improved by carrying out etching intermittently for a number of etch periods of equal length $t_1$ and rest periods $t_2$ and repeating the cycle as often as needed to reach the desired capacitance.

EXAMPLE 1

Soft aluminum foil of 3 mil initial thickness was etched in a static unit containing 1.4 M hydrochloric acid, 0.4 M aluminum chloride, and 0.2 M phosphoric acid at 45° C. and a frequency of 30 Hz. The number of passes refers to the number of times the current was switched on and off; duration is the length of time in seconds current was passed each time. The total charge passed is in coulombs/in$^2$ of foil, thickness is foil thickness after etching in mils, and capacitance is capacitance/unit area, $\mu$F/in$^2$. The rest periods were 5 sec long each.

TABLE 1

| Sample | Passes No. | Passes Duration | Total Charge | Thickness | Wt-loss % | Capacitance 10V | Capacitance 30V |
|---|---|---|---|---|---|---|---|
| 1 | 5 | 43 | 600 | 2.6 | 39.0 | 230.0 | 75.6 |
| 2 | 10 | 21 | 590 | 2.6 | 38.3 | 241.5 | 79.3 |
| 3 | 15 | 14 | 590 | 2.6 | 37.6 | 242.9 | 81.0 |
| 4 | 20 | 11 | 615 | 2.6 | 42.2 | 260.4 | 84.7 |

As the number of passes increases and duration decreases, providing the same total charge passed, capacitance increases.

EXAMPLE 2

In this example, the effect of varying the AC frequency was studied. There were 30 passes of 10 sec each with 5 sec rest periods, anodic current density was 2.8 A/in$^2$, and etchant bath temperature was 45° C. The etchant solution was 1.4 M hydrochloric acid, 0.4 M aluminum chloride, 0.7 M phosphoric acid, and 1.4 M chromium trioxide. The units are as in Example 1.

TABLE 2

| Sample | Freq,Hz | Thickness | Wt-loss,% | Capacitance 10V | Capacitance 30V |
|---|---|---|---|---|---|
| 1 | 2.5 | 1.9 | 70.6 | 174.5 | 44.9 |
| 2 | 5.0 | 2.0 | 66.2 | 200.7 | 53.9 |
| 3 | 10 | 2.2 | 51.8 | 120.7 | 33.0 |
| 4 | 20 | 2.7 | 40.5 | 229.5 | 59.8 |
| 5 | 25 | 2.7 | 40.4 | 390.3 | 99.6 |
| 6 | 30 | 2.8 | 39.3 | 427.6 | 114.5 |
| 7 | 40 | 2.8 | 34.4 | 445.1 | 132.2 |
| 8 | 50 | 2.8 | 32.5 | 460.4 | 139.7 |
| 9 | 60 | 2.9 | 30.7 | 396.4 | 121.1 |

EXAMPLE 3

This example shows the effect of changing the length of the rest period. The electrolyte was 1.4 M hydrochloric acid, 0.4 M aluminum trichloride and 0.22 M phosphoric acid. The temperature was 45° C., and $t_1$ and $t_2$ are in seconds.

TABLE 3

| $t_1$ | $t_2$ | No. passes | A/in$^2$ | Thickness | Wt-loss,% | Capacitance 10V | Capacitance 30V |
|---|---|---|---|---|---|---|---|
| 4.5 | 5.0 | 20 | 3.2 | 2.7 | 20.4 | 212 | 55.4 |
| 7.5 | 3.0 | 28 | 2.8 | 2.45 | 38.4 | 239 | 76.0 |
| 10.0 | 10.0 | 20 | 2.8 | 2.58 | 38.2 | 234 | 66.6 |

Since a rest period of 10 seconds is the length of time that current etch machines provide, longer times were not tried although there are indications they would prove useful and beneficial.

What is claimed is:

1. A process for electrolytic etching of aluminum capacitor foil comprising passing said foil through an electrolyte bath between two electrodes in an insulated frame, continuously supplying AC current to said electrodes, subjecting said foil to AC etching for a period of time $t_1$ during which said foil is between said electrodes and during which all current passed is utilized for etching followed by a rest period of time $t_2$ of up to 10 seconds during which said foil is outside said frame and outside said electrodes and during which no electrochemical etching takes place, subjecting said foil to AC etching for another period of time $t_1$ followed by another nonetching period $t_2$, and repeating said etching and nonetching periods until the foil has been etched to the desired level.

2. A process according to claim 1 wherein there are 5 to 20 etching-nonetching cycles.

3. A process according to claim 1 wherein said period $t_1$ are each of 5 sec to 40 sec duration.

4. A process according to claim 1 wherein said periods $t_1$ are each of 10 seconds duration.

5. A process according to claim 1 wherein said rest periods are each of 3 to 10 seconds duration.

6. A process according to claim 1 wherein said rest periods are each of 5 seconds duration.

* * * * *